US005553721A

United States Patent [19]

Gebka

[11] Patent Number: 5,553,721

[45] Date of Patent: Sep. 10, 1996

[54] REVERSIBLE STRIP MERCHANDISER

[75] Inventor: John Gebka, Coral Springs, Fla.

[73] Assignee: Fast Industries, Inc., Ft. Lauderdale, Fla.

[21] Appl. No.: 356,714

[22] Filed: Dec. 15, 1994

[51] Int. Cl.[6] ..... A47F 5/00

[52] U.S. Cl. ..... 211/59.1; 211/73; 211/113; 211/118

[58] Field of Search ..... 211/57.1, 59.1, 211/113, 118, 71, 72, 73; 248/220.31, 220.41, 909; 206/482, 45.14, 372, 806

[56] References Cited

U.S. PATENT DOCUMENTS

| | | | |
|---|---|---|---|
| 1,391,287 | 9/1921 | Waldes . | |
| 2,155,313 | 3/1937 | Jackson . | |
| 2,458,729 | 6/1945 | Politzer . | |
| 2,598,492 | 5/1949 | Boes . | |
| 4,483,502 | 11/1964 | Fast . | |
| 4,546,943 | 10/1985 | Fast . | |
| 4,718,627 | 1/1988 | Fast . | |
| 4,762,225 | 8/1988 | Henkel . | |
| 4,911,392 | 3/1990 | Fast . | |
| 5,096,070 | 3/1992 | Jaynes . | |
| 5,103,970 | 4/1992 | Nielson et al. . | |
| 5,199,578 | 4/1993 | Pendergraph et al. | 211/72 |
| 5,248,036 | 9/1993 | Radocha et al. . | |
| 5,284,258 | 2/1994 | Genero et al. . | |
| 5,284,259 | 2/1994 | Conway et al. | 211/113 X |
| 5,333,909 | 8/1994 | Hedge, Jr. . | |
| 5,386,916 | 2/1995 | Valiulis . | |

FOREIGN PATENT DOCUMENTS

| | | |
|---|---|---|
| 1344782 | 1/1959 | France . |

OTHER PUBLICATIONS

Sell Strip Strip Merchandisers for Wal–Mart—Fast Industries Inc.

Fast Label Holders & Merchandising Aids–Apr. 1992.

Fast "Sell Strip" Strip Merchandisers and "Wonderhook".

Leco Plastics, Inc.—Leco–Strip.

DO–IT Corporation—Continuous Display Strip and pre–cut display Strips–May 1993.

*Primary Examiner*—Robert W. Gibson, Jr.

*Attorney, Agent, or Firm*—Jacobson, Price, Holman & Stern, PLLC

[57] ABSTRACT

A strip merchandiser made of plastic sheet has W-shaped slits defining central fingers pointing towards one end of the strip for suspending apertured products and outer fingers pointing towards the opposite end of the slip for suspending slotted products. Mounting panels for hanging the strip from a merchandise display shelf are provided at both ends of the strip so that it can be used reversibly depending on the type of products to be displayed thereon.

17 Claims, 2 Drawing Sheets

40
52
54
50
48
34
32
36
38

REVERSIBLE STRIP MERCHANDISER

BACKGROUND OF THE INVENTION

This invention relates to strip merchandisers generally of the kind which are disclosed, for example, in prior U.S. Pat. Nos. 4,483,502; 4,546,943; 4,718,627 and 4,911,392. The disclosures of these patents are expressly incorporated herein by reference.

Each of the above patents discloses a merchandise display element in the form of an elongate plastic strip (i.e., a strip merchandiser) having a mounting portion at one end by which the strip can be suspended from the front edge of a merchandise display shelf or the like, and an elongated body portion with a series of superposed suspension fingers from each of which an apertured product, such as blister pack, can be suspended. In use, the strip is secured to a shelf by way of the mounting portion and the fingers are loaded with a vertical row of products which can then be removed individually by customers from the respective fingers.

Some products which are commonly displayed on strip merchandisers, have relatively small central suspension apertures while other products have elongated transverse suspension slots. If a strip merchandiser with relatively narrow suspension fingers, suitable for apertured products, is used to display the slotted products, an untidy display may result insofar as the slotted products may slide randomly along the suspension fingers. Also, strip merchandisers having wider suspension fingers suitable for slotted products obviously cannot be used to suspend products having the smaller suspension apertures. It is an object of this invention to provide a strip merchandiser having suspension formations which are equally suitable for both apertured and slotted products.

SUMMARY OF THE INVENTION

The invention provides a strip merchandiser of the kind referred to which can be used reversibly, i.e., suspended from a shelf selectively from either one of its ends dependent on whether it is to be used to display slotted or apertured products. Further, the strip has reversible product suspension formations each in the form of a W-shaped slit. Each slit defines a pair of outer fingers pointing towards one end of the strip and which straddle a central finger pointing towards the opposite end of the strip. Mounting portions for suspending the strip from a shelf are provided at both ends of the strip.

When the strip is to be used for apertured products, the central finger of each suspension formation is selected to suspend a product while the outer fingers may be used to interlock the product in place, and the strip is suspended by the mounting portion at the end towards which the central fingers point. Alternatively, when the strip is to be used for slotted products, the two outer fingers of each suspension formation selected to suspend a product while the central finger may be used to interlock the product in place and the strip is suspended by the mounting portion at the opposite end towards which the outer fingers point. Because of the lateral spacing of the outer fingers, these perform like a strip with wide fingers effectively taking up a substantial width of the slot in each product and thereby substantially eliminating untidy misalignments of the products.

In a preferred form of the invention, the outer (free) ends of each W-shaped slit in the strip are formed with reverse somewhat U-shaped curves. This structure prevents the strip from tearing at these points, for example, when the fingers are placed under load. Extending the ends of each slit in this manner is a more cost effective method than providing a stamped aperture at each end of the slit which is an alternative structure for preventing the strip from tearing.

In accordance with another feature of the invention, a strip merchandiser is divided lengthwise by transverse fold lines into a series of contiguous panels and W-shaped suspension formations are provided on selected ones of the panels, for example, on alternate panels. This structure allows the strip to be preloaded with products, for example, flattish blister pack or like cards, and folded along the fold lines in such a way that the products effectively concertina together against one another and form a compact bundle which can be suitably parcelled for shipping. The strip can then be unparcelled and unfolded at the point of sale and saves having to load the strip in situ. The interlocking fingers of each suspension formation are useful in this arrangement for locking the products onto the strip. This feature of the invention is useful for strips having a mounting portion at only one end or at both ends.

Additional features and advantages of the invention will become apparent from the ensuing description and claims read in conjunction with the attached drawings.

DESCRIPTION OF PREFERRED EMBODIMENTS

Figure 1:
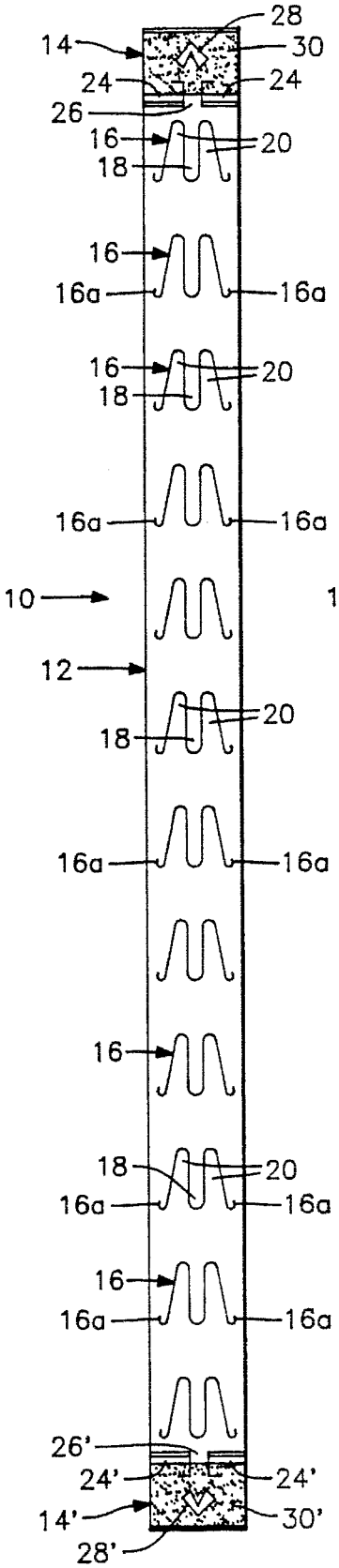
FIG. 1 is a plan view of a strip merchandiser according to the invention shown with one end up.
Figure 2:
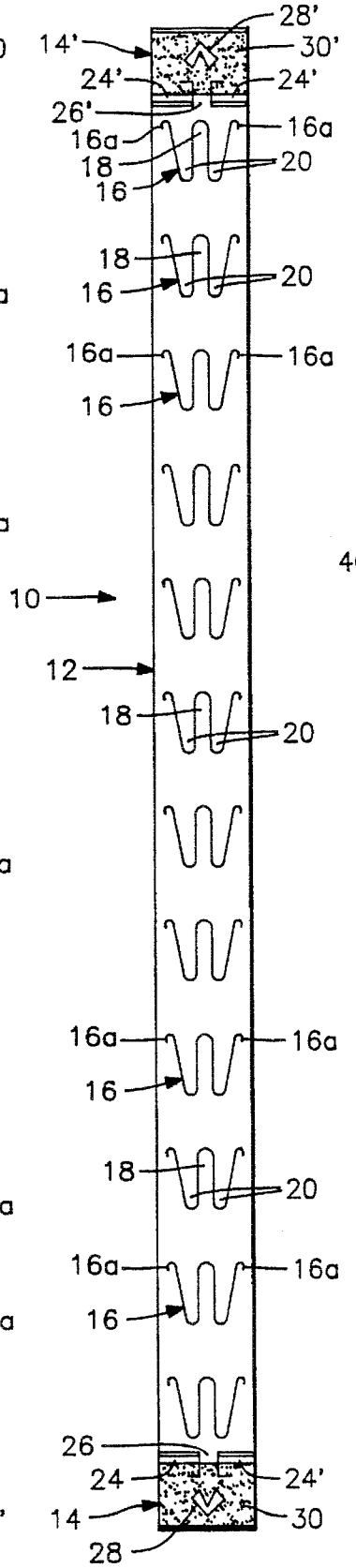
FIG. 2 is a view of the strip similar to FIG. 1, but with the other end up.

Referring initially to FIGS. 1 and 2, there is shown a strip merchandiser 10, which may, for example, be die cut or the like from a plastic sheet in known manner, to provide a body portion 12 and mounting panels 14, 14' at the top and bottom of the body portion. FIG. 1 shows the strip with mounting panel 14 at the top and FIG. 2 shows the strip reversed, with mounting panel 14' at the top. The body portion 12 is provided with a series of superposed W-shaped slits 16 each defining a central finger 18 pointing towards mounting panel 14' and a pair of outer fingers 20 pointing towards mounting panel 14. Also, the free outer ends of each W-shaped slit are extended by reversed curves 16a defining a small U-shaped formation to prevent the strip from tearing at these points when it is under load.

The two mounting panels 14, 14' are each provided with like mounting means for suspending the strip from the front of a merchandise display shelf. In the illustrated embodiment the mounting means are universal mounting means of the kind disclosed in the above-noted U.S. Pat. No. 4,718, 627, but such mounting means are only exemplary of suitable mounting means and other mounting means can also be used.

In explanation of the universal mounting means referred to above, the panels 14, 14' are separated from the body portion 12 by U-shaped slits 24, 24' the inner limbs of which extend to the edges of the strip and which define between them respective stem portions 26, 26'. This structure allows either mounting panel to be fitted in a price channel at the front edge of a shelf as shown, for example, in FIG. 3 of U.S. Pat. No. 4,718,627. Also, the panels 14, 14' have press-out arrowhead formations 28, 28' enabling the respective mounting panel to be secured in an aperture of an apertured shelf, as shown for example in FIGS. 5 and 6 of the patent or suspended from a hook as shown in FIG. 11 of the patent. Additionally, to what is shown in the patent, each mounting panel may have a strip of adhesive 30 or 30' on one surface (normally covered by release paper, not shown) whereby the strip can, for example, be adhered to a plain-fronted shelf or the like.

The strip can be used to suspend apertured products from the central fingers 18, with the central fingers pointing upwardly as shown in FIG. 2 or it can be used to suspend slotted products from the outer fingers 20, with the outer fingers pointing upwardly as shown in FIG. 1. The manner in which such products are mounted will be described below with reference to the embodiment of strip shown in FIG. 3.

Figure 3:
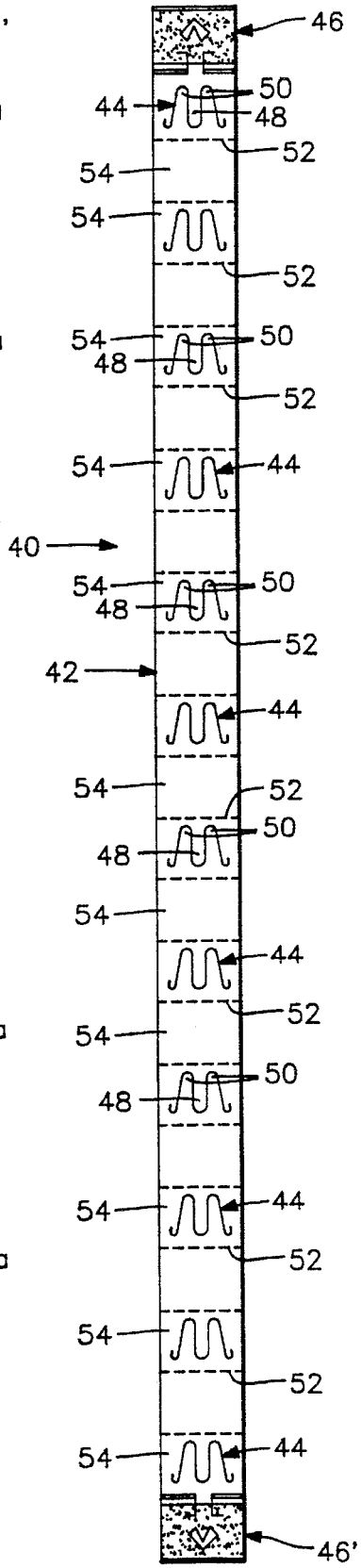
FIG. 3 is a plan view of an alternative strip merchandiser according to the invention.

FIG. 3 shows a modified strip merchandiser 40 having a main body portion 42 with W-shaped slits 44 like those previously described defining central and outer fingers 48, 50 and mounting panels 46, 46' at its opposite ends, again with universal mounting means as previously described enabling the strip to be suspended from either end depending on whether it is used for slotted or apertured products. In this case, however, body portion 42 is divided by transverse fold lines 52 (score lines or perforations) into a row of contiguous panels 54 and the slits 44 are provided in alternate ones of the panels only.

Slotted products, such as blister pack cards 32 (FIGS. 4–6) with suspension slots 34 may be suspended from the sets of outer fingers 50 so, by flexing the respective pair of fingers 50 outwardly, suspending the product from the fingers 50 and flexing the central finger 48 which is between the two outer fingers 50 over the front of the suspended product to lock the product in place on the strip. When the strip is loaded with products it can be suspended from a shelf using mounting panel 46.

Apertured products on the other hand, such as blister pack card 36 (FIG. 7) with a small central aperture 38 may be suspended from the central fingers 48 by flexing a central finger outwardly, suspending a product therefrom and flexing the adjacent outer fingers 50 over the front of the product to lock it in place on the strip. In this case, the loaded strip can be suspended from a shelf using mounting panel 46'.

It will be understood that slotted and apertured products are suspended from the fingers 18 or 20 of strip 10 in the same manner as described above.

Figures 4, 5, 6, 7:
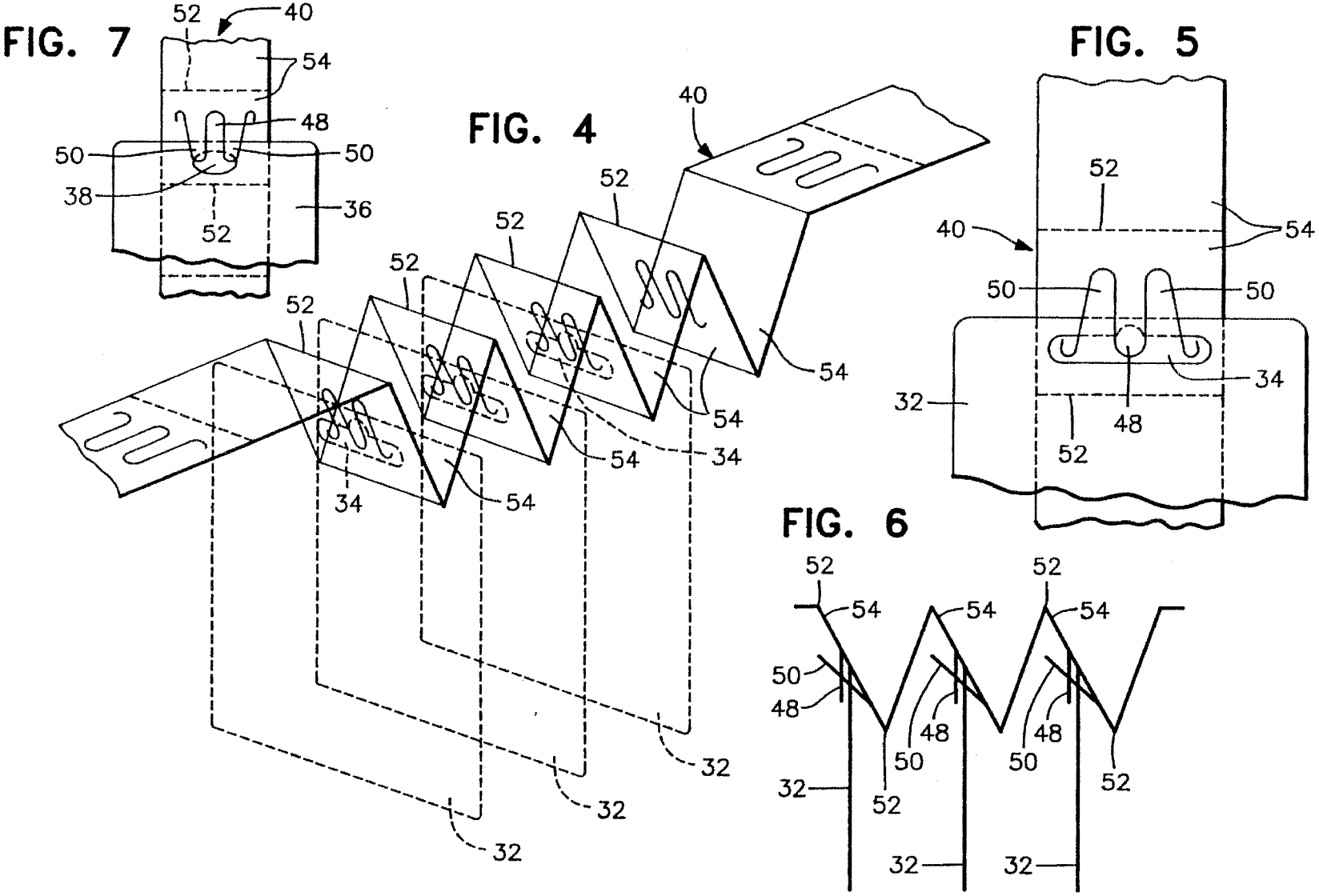
FIG. 4 is an enlarged perspective view of a part of the strip merchandiser of FIG. 3 shown folded and with slotted products attached.
FIG. 5 is a front view of a part of the strip of FIG. 3 showing suspension of a slotted product using a pair of outer suspension fingers.
FIG. 6 is a side elevational view of that part of the strip shown in FIG. 4.
FIG. 7 is a view similar to FIG. 5, with the strip reversed, showing suspension of an apertured product using a central suspension finger.

The provision of the fold lines 52 in strip 40 provides the strip with an additional facility of enabling products to be pre-loaded on the strip as shown in FIGS. 4 and 6 and concertinad together by alternately folding the strip panels backwards and forwards. This allows the products to be formed into a compact bundle for parcelling up and shipment, so that at a point of sale the strip can simply be unwrapped and unfolded and it is unnecessary to load the strip with products in situ. In this case, the finger formations as previously described serve to lock the products on the strip during shipping and display.

While only preferred embodiments of the invention have been described herein in detail, the invention is not limited thereby and modifications can be made within the scope of the attached claims.

I claim:

1. A strip merchandiser comprising a strip of plastic sheet material having an elongate main body portion and a mounting portion at each end of the body portion for hanging the strip from a merchandise display shelf and the like, the body portion including at least one product suspension means including a first suspension formation for suspending a first kind of product from the strip with one of the mounting portions used for hanging the strip, and a second suspension formation distinguished from the first suspension formation for suspending a second kind of product from the strip with the strip reversed lengthwise and with the other of said mounting portions used for hanging the strip, wherein each mounting portion included universal mounting means for selectively hanging the strip on different articles, said suspension means comprising a W-shaped slit in the strip defining a central flexible finger pointing towards said one of the mounting portions, said central flexible finger defining the first suspension formation, and a pair of outer flexible fingers pointing towards said other of said mounting portions and straddling the central finger, said outer flexible fingers together defining said second suspension formation, said slits being replicated at intervals lengthwise along the body portion, said body portion being divided lengthwise by transverse fold lines into a plurality of contiguous panels, and said slits being provided in selected ones of said panels.

2. A strip merchandiser comprising a strip of plastic sheet material having an elongate main body portion and a mounting portion at each end of the body portion for hanging the strip from a merchandise display shelf and the like, the body portion including at least one product suspension means including a first suspension formation for suspending a first kind of product from the strip with one of the mounting portions used for hanging the strip, and a second suspension formation distinguished from the first suspension formation for suspending a second kind of product from the strip with the strip reversed lengthwise and with the other of said mounting portions used for hanging the strip, wherein each mounting portion includes universal mounting means for selectively hanging the strip on different articles, said universal mounting means including at least an adhesive mounting means for adhesively securing the strip on a surface.

3. A strip merchandiser comprising a strip of plastic sheet material having an elongate main body portion and a mounting portion at each end of the body portion for hanging the strip from a merchandise display shelf and the like, the body portion including at least one product suspension means including a first suspension formation for suspending a first kind of product from the strip with one of the mounting portions used for hanging the strip, and a second suspension formation distinguished from the first suspension formation for suspending a second kind of product from the strip with the strip reversed lengthwise and with the other of said mounting portions used for hanging the strip, wherein each mounting portion includes universal mounting means for selectively hanging the strip on different articles, said universal mounting means including at least a press-out formation for insertion in a shelf aperture to suspend the strip from the shelf.

4. A strip merchandiser comprising a strip of plastic sheet material having an elongate main body portion and a mounting portion at each end of the body portion for hanging the strip from a merchandise display shelf and the like, the body portion including at least one product suspension means including a first suspension formation for suspending a first kind of product from the strip with one of the mounting portions used for hanging the strip, and a second suspension formation distinguished from the first suspension formation for suspending a second kind of product from the strip with the strip reversed lengthwise and with the other of said mounting portions used for hanging the strip, wherein each mounting portion includes universal mounting means for selectively hanging the strip on different articles, said universal mounting means including at least a mounting panel for securing the mounting means in a price channel along the front of a merchandise display shelf.

5. A strip merchandiser comprising a strip of plastic sheet material having an elongate main body portion and a mounting portion at each end of the body portion for hanging the strip from a merchandise display shelf and the like, the body portion including at least one product suspension means including a first suspension formation for suspending a first kind of product from the strip with one of the mounting portions used for hanging the strip, and a second suspension formation distinguished from the first suspension formation for suspending a second kind of product from the strip with the strip reversed lengthwise and with the other of said mounting portions used for hanging the strip, wherein each mounting portion includes universal mounting means for selectively hanging the strip on different articles, each mounting portion comprising a mounting panel defining said universal mounting means, said panel being separated from the body portion of the strip by lateral slits extending inwardly from opposite sides of the strip and defining a central stem therebetween connecting the mounting panel to the body portion of the strip.

6. A strip merchandiser as claimed in claim 2 wherein the suspension means comprises a W-shaped slit in the strip defining a central flexible finger pointing towards said one of the mounting portions, said central flexible finger defining the first suspension formation and a pair of outer flexible fingers pointing towards said other of said mounting portions straddling the central finger, said outer flexible fingers together defining said second suspension formation.

7. A strip merchandiser as claimed in claim 6 wherein the slits are replicated at intervals lengthwise along the body portion.

8. A method of presenting for display a product having an opening therein by which the product can be suspended from a suspension formation of a strip merchandiser, the method comprising providing a strip merchandiser in the form of a strip of plastic sheet material having an elongate main body portion and a mounting portion at each end of the body portion for hanging the strip from a support, the body portion including product suspension means including a first suspension formation for suspending a product having a first kind of suspension opening from the strip and a second suspension formation distinguished from the first suspension formation for suspending a product having a second kind of suspension opening from the strip with the strip reversed lengthwise, selecting which of the first and second suspension formations is suitable for the opening in the product to be displayed, suspending the product from the selected suspension formation, determining which of the mounting portions to use for hanging the strip and suspended product from a support, and hanging the strip from the selected mounting portion.

9. A method as claimed in claim 8 wherein the suspension means is replicated at intervals lengthwise along the body portion of the strip and a product is suspended from a selected suspension formation of each suspension means.

10. A method of presenting for display a product having an opening therein by which the product can be suspended from a suspension formation of a strip merchandiser, the method comprising providing a strip merchandiser in the form of a strip of plastic sheet material having an elongate main body portion and a mounting portion at each end of the body portion for hanging the strip from a support, the body portion including product suspension means including a first suspension formation for suspending a product having a first kind of suspension opening from the strip and a second suspension formation distinguished from the first suspension formation for suspending a product having a second kind of suspension opening from the strip with the strip reversed lengthwise, selecting which of the first and second suspension formations is suitable for the opening in the product to be displayed, suspending the product from the selected suspension formation and determining which of the mounting portions to use for hanging the strip and suspended product from a support, the suspension means being replicated at intervals lengthwise along the body portion of the strip with a product being suspended from a selected suspension formation of each suspension means, the suspension means being provided on selected foldable panels forming the body portion of the strip the method including a further step of reversely folding alternate panels of the strip to concertina the products together into a compact bundle.

11. A method as claimed in claim 8 wherein the first kind of suspension opening is a circular opening and the second kind of suspension opening is an oval opening having a wider transverse dimension, the product suspension means comprising a W-shaped slit in the strip merchandiser defining a central flexible finger pointing toward one of the mounting portions, the central flexible finger defining the first suspension formation, and a pair of outer flexible fingers pointing toward the other of the mounting portions and straddling the central finger, the outer flexible fingers together defining the second suspension formation.

12. A strip merchandiser as claimed in claim 3 wherein the suspension means comprises a W-shaped slit in the strip defining a central flexible finger pointing towards said one of the mounting portions, said central flexible finger defining the first suspension formation, and a pair of outer flexible fingers pointing towards said other of said mounting portions and straddling the central finger, said outer flexible fingers together defining said second suspension formation.

13. A strip merchandiser as claimed in claim 4 wherein the suspension means comprises a W-shaped slit in the strip defining a central flexible finger pointing towards said one of the mounting portions, said central flexible finger defining the first suspension formation, and a pair of outer flexible fingers pointing towards said other of said mounting portions and straddling the central finger, said outer flexible fingers together defining said second suspension formation.

14. A strip merchandiser as claimed in claim 5 wherein the suspension means comprises a W-shaped slit in the strip defining a central flexible finger pointing towards said one of the mounting portions, said central flexible finger defining the first suspension formation, and a pair of outer flexible fingers pointing towards said other of said mounting portions and straddling the central finger, said outer flexible fingers together defining said second suspension formation.

15. A strip merchandiser as claimed in claim 12 wherein the slits are replicated at intervals lengthwise along the body portion.

16. A strip merchandiser as claimed in claim 13 wherein the slits are replicated at intervals lengthwise along the body portion.

17. A strip merchandiser as claimed in claim 14 wherein the slits are replicated at intervals lengthwise along the body portion.

* * * * *